US008087493B2

(12) United States Patent
Kempf et al.

(10) Patent No.: US 8,087,493 B2
(45) Date of Patent: Jan. 3, 2012

(54) SOUND ABSORBER FOR A PIPE-SHAPED, CAVITY-FORMING BODY

(75) Inventors: Dominik Kempf, Frankfurt am Main (DE); Denny Liers, Weinsheim (DE); Olaf Emmerich, Mannheim (DE)

(73) Assignee: TI Automotive Engineering Centre (Heidelberg) GmbH, Heidelberg (DE)

( * ) Notice: Subject to any disclaimer, the term of this patent is extended or adjusted under 35 U.S.C. 154(b) by 0 days.

(21) Appl. No.: 12/903,793

(22) Filed: Oct. 13, 2010

(65) Prior Publication Data

US 2011/0088968 A1 Apr. 21, 2011

Related U.S. Application Data

(60) Provisional application No. 61/262,755, filed on Nov. 19, 2009.

(30) Foreign Application Priority Data

Oct. 16, 2009 (EP) ..... 09013111

(51) Int. Cl.
*F01N 1/02* (2006.01)
*F01N 1/10* (2006.01)
*F02M 35/00* (2006.01)

(52) U.S. Cl. ..... 181/250; 181/229; 181/252

(58) Field of Classification Search ..... 181/250, 181/229, 252
See application file for complete search history.

(56) References Cited

U.S. PATENT DOCUMENTS

| | | | | | |
|---|---|---|---|---|---|
| 2,051,515 | A * | 8/1936 | Bourne | 181/252 |
| 2,127,672 | A * | 8/1938 | Bourne | 181/273 |
| 2,271,892 | A * | 2/1942 | Bourne | 181/248 |
| 2,311,676 | A * | 2/1943 | Maxim | 181/252 |
| 3,043,499 | A * | 7/1962 | Adam et al. | 417/536 |
| 4,607,723 | A * | 8/1986 | Okazaki | 181/272 |
| 5,317,112 | A * | 5/1994 | Lee | 181/250 |
| 6,116,375 | A * | 9/2000 | Lorch et al. | 181/224 |
| 6,265,081 | B1 * | 7/2001 | Urabe et al. | 428/474.4 |
| 2004/0007197 | A1 * | 1/2004 | Hellie et al. | 123/184.57 |
| 2004/0069563 | A1 * | 4/2004 | Zirkelbach | 181/269 |
| 2005/0045239 | A1 * | 3/2005 | Krieger et al. | 138/44 |
| 2007/0295554 | A1 * | 12/2007 | Flucht et al. | 181/213 |
| 2008/0023262 | A1 * | 1/2008 | Hayashi et al. | 181/229 |
| 2010/0193282 | A1 * | 8/2010 | Kim et al. | 181/229 |
| 2011/0073406 | A1 * | 3/2011 | Ortman et al. | 181/276 |
| 2011/0074067 | A1 * | 3/2011 | Khami et al. | 264/513 |

FOREIGN PATENT DOCUMENTS

| | | | |
|---|---|---|---|
| DE | 43 27 562 | A1 | 2/1995 |
| SU | 1453057 | A * | 1/1989 |
| SU | 1453057 | A1 * | 1/1989 |

* cited by examiner

*Primary Examiner* — Anh Mai
*Assistant Examiner* — Christina Russell
(74) *Attorney, Agent, or Firm* — Leydig, Voit & Mayer, Ltd.

(57) ABSTRACT

The present invention relates to a coolant circuit of a cooling system including a pipe-shaped body defining a cavity. It has a sound absorber defining a flow channel and at least one resonator chamber which is connected to the flow channel via a connection channel. The sound absorber is an insert in the cavity of the pipe-shaped body, which forms the flow channel, the at least one resonator chamber, and the at least one connection channel.

12 Claims, 4 Drawing Sheets

SOUND ABSORBER FOR A PIPE-SHAPED, CAVITY-FORMING BODY

This application claims priority pursuant to Title 35 USC Section 119 to European application No. 09013111.1, filed Oct. 16, 2009, and to U.S. provisional application Ser. No. 61/262,755, filed Nov. 19, 2009, the contents of each of which are hereby incorporated by reference herein.

The present invention relates to a sound absorber for a pipe-shaped, cavity-forming body having a flow channel and at least one resonator chamber which is connected to the flow channel via a connection channel.

A resonator sound absorber for pipes is known from DE 43 27 562 A1, for example. A sound absorber for pipes through which hot gases flow having multiple concentrically situated sound absorbing chambers is known from this publication.

U.S. Pat. No. 6,116,375 describes an acoustic resonator which has multiple resonator chambers. The resonator chambers may be situated along the interior circumference or on the exterior circumference of the pipe.

Another sound absorber having resonator chambers situated on the exterior circumference of the pipe is known from United States Publication US2004/0069563 A1.

The above-mentioned sound absorbers have the disadvantage that they are complex and expensive to manufacture. In addition, they require a large installation space which is frequently not available, particularly in applications for the automobile industry.

The object of the present invention is to provide a sound absorber of the type mentioned at the outset which makes effective noise absorption possible and requires little manufacturing expenditure and low installation complexity.

This object is achieved in a sound absorber of the above-defined species by designing the sound absorber as an insert which is insertable or inserted into the cavity of the pipe-shaped body, the insert delimiting the at least one resonator chamber and the flow channel.

This design enables effective absorption of noises by using the acoustic resonator principle. The gas volume enclosed in the resonator chamber is connected to the flow channel via the preferably narrow connection channel. A mechanical mass-spring system having a distinct natural resonance occurs due to the elasticity of the gas volume in the interior of the resonator chamber in combination with the inert mass of the gas situated in the connection channel. Occurring noise may be effectively reduced due to this natural resonance. If the frequency of the noise source is known, the natural frequency of the resonator chamber may be adjusted to this. In order to enable absorption of noises in different frequency ranges, multiple resonator chambers each having different natural frequencies may be provided. According to the present invention, the sound absorber is designed as an insert, the insert forming the at least one resonator chamber and the flow channel. In this way, the sound absorber is particularly easily manufacturable. It is sufficient to place the insert into the pipe-shaped body. Further adaptations to the pipe-shaped body are not absolutely necessary. Moreover, the sound absorber does not require any additional installation space on the exterior of the pipe-shaped body. In this way, the assembly may be carried out particularly easily since the sound absorber is manufactured separately and needs only be inserted into the pipe-shaped body. The manufacturing costs are also low due to the design of the sound absorber as an insert. A sound absorber of this type is particularly suitable for pipe-shaped bodies through which gas flows. For example, it may be used in a cooling circuit of a cooling system in order to effectively dampen the noises of the compressor. The sound absorber is particularly suitable for mobile cooling systems, e.g., in a motor vehicle.

According to an advantageous embodiment of the present invention, it is provided that the insert has a partition which forms the flow channel and separates it from the at least one resonator chamber. The partition may be formed here by a section of the insert which forms an inner pipe. In this way, a sound absorber is obtained which may be easily manufactured and assembled. The inner pipe forms the flow channel in the interior of the sound absorber. This may be placed coaxially in the pipe-shaped body. The inner pipe may have a round or an angular cross section. The flow channel is preferably situated in the interior of the inner pipe, while the at least one resonator chamber is formed on the exterior of the inner pipe, in the space formed between the inner pipe and the pipe-shaped body.

An inner cross section area of the inner pipe advantageously changes in the axial direction of the insert. This may be achieved in particular in such a way that the inner pipe, starting from an inlet cross section area at an inlet of the sound absorber, narrows to an intermediate cross section area and expands from there to an outlet cross section area at the outlet of the sound absorber. In this way, the space for the resonator chamber or resonator chambers may be created using the insert without having to modify the pipe-shaped body. Nonetheless, a low flow resistance for a gas flowing through the flow channel may be obtained. This flow resistance is kept particularly low if the change in the inner cross section area in the axial direction does not occur suddenly. This may be achieved by a conical design of the inner pipe, at least in some sections. If the inlet cross section area and the outlet cross section area of the sound absorber correspond essentially to the inner cross section area of the pipe-shaped body, further adjustments of the insert or of the pipe-shaped body are not necessary in order to guide the fluid into the flow channel. The inner pipe advantageously fits tightly on the pipe-shaped body in the areas of the inlet and the outlet of the sound absorber.

One advantageous embodiment of the present invention provides that the insert has at least one web, pointing to the outside, for fitting on the inner wall of the pipe-shaped body, the at least one web delimiting the resonator chamber in an axial direction of the insert. The web may be situated on the exterior of the inner pipe and forms a spacer. In this way, the space required for the resonator chamber is formed between the inner pipe and the pipe-shaped body. The web may be designed as a circumferential ring-shaped bead, for example. In addition, such a web is advantageous when the sound absorber is used in a curved pipe-shaped body. With the web fitting on the pipe-shaped body, the insert is able to adapt to the radius of curvature of the pipe-shaped body even if it is manufactured without a curvature or with a different curvature.

A particularly compact configuration results when the web separates two adjacent resonator chambers. In this case, the sound absorber may have, in a simple manner, multiple resonator chambers which are attuned to different natural frequencies, which makes it possible to reduce sound in different frequency ranges. For example, in order to form multiple resonator chambers, multiple webs may be provided spaced in the axial direction, one web separating two resonator chambers.

Easy manufacture and assembly also result due to the fact that the connection channel is formed by a channel-shaped section in the partition. Additional components are not necessary in this design. The insert may advantageously be a one-piece component together with the partition and the connection channel which may be manufactured as a contiguous injection-molded part. The length and the diameter of the connection channel (or of the connection channels) may be selected according to the Helmholtz resonator principles in such a way that the respective natural frequency of the resonator chamber is in the intended frequency range. The channel-shaped section advantageously runs in the radial direction.

A further improvement is achieved by the fact that the at least one resonator chamber has, in an axial direction of the insert, a changing inner diameter while the outer diameter remains constant. In this way, in particular the flow resistance in the flow channel may be kept low.

The usability and the assembly are further improved when the sound absorber is made of an elastically bendable material. In this way, the sound absorber may be inserted into pipe-shaped bodies having a curve or into flexible hoses. For example, an elastic plastic may be used as the elastically bendable material. In this way it may be achieved that the ends of the insert may assume a bending angle to one another of more than 5°, in particular more than 20°, and advantageously up to 90°.

Effective noise absorption in multiple frequency ranges may advantageously be achieved in that multiple resonator chambers are formed in the axial direction adjacent to one another which are each connected to the flow channel via a connection channel. Each of the resonator chambers may be attuned to a different natural frequency. It has been proven advantageous in practice to provide up to four resonator chambers adjacent to one another which make it possible to reduce the noise in a corresponding number of frequency ranges. Depending on the application, one single resonator chamber may be sufficient or a greater number of resonator chambers may be provided.

The at least one resonator chamber is advantageously delimited on its exterior by a wall of the pipe-shaped body. In particular, the resonator chamber may be delimited to the outside by the interior of the pipe-shaped body which then forms the exterior of the resonator chamber while it is delimited to the interior by the insert. As an alternative, the insert may also have an additional wall which delimits the resonator chamber or the resonator chambers in the radial direction to the outside.

For being fixed in the pipe-shaped body, the insert advantageously has a clamping zone on its exterior, which is used for fixing the sound absorber after being inserted into the pipe-shaped body. Fixing is particularly simple if the pipe-shaped body is made of a deformable material and is fastened to the clamping zone by a clamping device such as a hose clamp, for example. The pipe-shaped body may be made of an elastically deformable material, e.g., plastic, or a ductile material, e.g., aluminum, which is stamped into the clamping zone. In order to obtain a good fastening, the clamping zone may be delimited by a clamping edge on one or both sides. This makes it possible to achieve a positive fit between the insert and the pipe-shaped body. The clamping edge may be formed by the web. A compact configuration may be achieved if the clamping edge has breakthroughs because the volume on both sides of the clamping edge may be part of a resonator chamber.

Moreover, the present invention relates to a pipe-shaped body, in particular for the coolant circuit of a cooling system, into which a sound absorber as recited in one of the preceding claims is inserted. The pipe-shaped body may have a rigid or a flexible design. The pipe-shaped body is advantageously a flexible hose made of plastic, for example.

The pipe-shaped body advantageously has the same diameter in the area in which the insert is situated and in the areas adjacent in the axial direction. Modifications on the pipe-shaped body, in particular a widening, in order to provide the resonator chambers there, are not necessary. The insert may simply be inserted into the pipe-shaped body, which may be continuous, for example.

Further features, advantages, and application options of the present disclosure arise from the following description of exemplary embodiments based on the drawing. All described and/or depicted features by themselves or in any combination, also independently of their being combined in individual claims or of their back reference.

Figure 1:
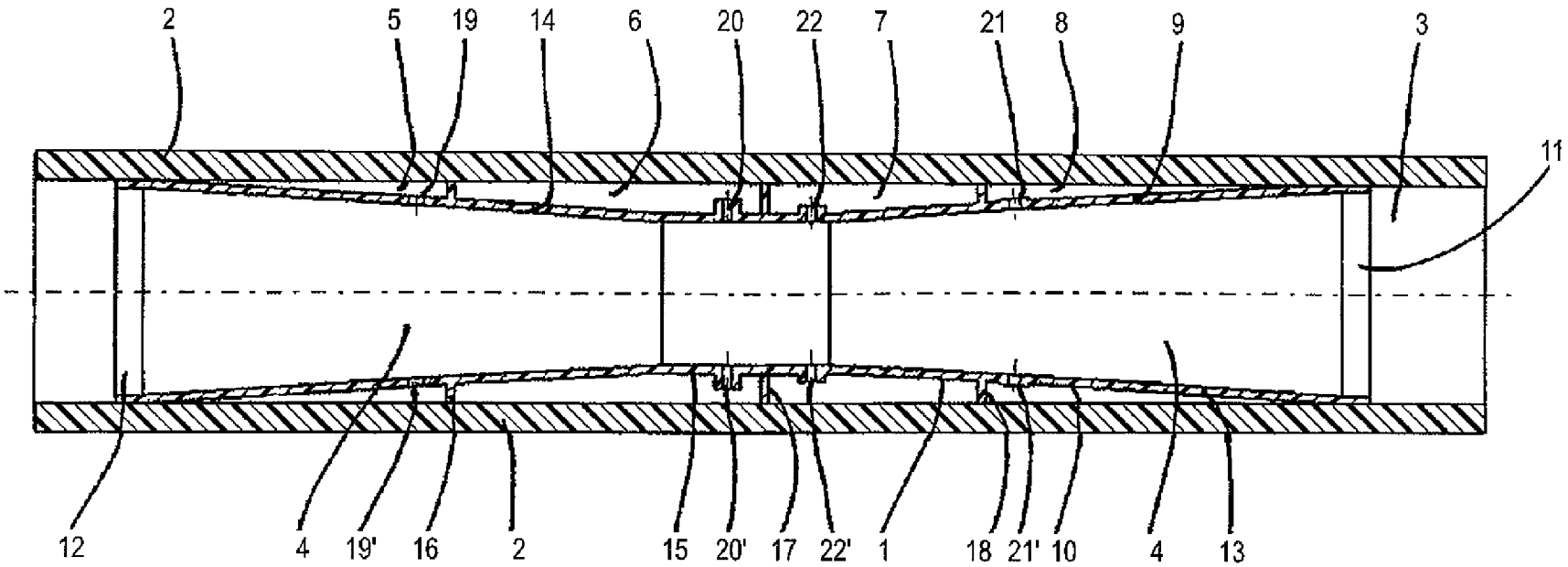
FIG. 1 shows a sectional view of a sound absorber according to the present invention inserted into a straight pipe-shaped body.

Referring to FIG. 1, there is shown a sound absorber 1 for a pipe-shaped body 2 which forms a cavity 3. Pipe-shaped body 2 may be a pipe made of plastic or metal, for example. Pipe-shaped body 2 may be made of an elastically deformable material and may be designed as a hose, for example. Pipe-shaped body 2 may be in particular a part of a coolant circuit of a cooling system in which the coolant circulates in the interior of the pipe-shaped body. The depicted sound absorber 1 is suitable in particular for that part of a coolant circuit in which the coolant is present in gaseous form. In this way, sound absorber 1 may effectively reduce the noise generated by a compressor (not shown). Sound absorber 1 is designed as an insert 26 which is manufactured separately and inserted during assembly into cavity 3 of pipe-shaped body 2.

Sound absorber 1 has a central flow channel 4. Flow channel 4 is situated coaxially with pipe-shaped body 2. Furthermore, four resonator chambers 5, 6, 7, 8 are provided adjacent to one another in the axial direction. Flow channel 4 and resonator chambers 5, 6, 7, 8 are separated by a partition 9 which forms flow channel 4 on its inside and separates it from the respective outside resonator chamber 5, 6, 7, and 8. Partition 9 is formed by a section of sound absorber 1 designed as an insert. Resonator chambers 5, 6, 7, 8 extend here ring-like around inner pipe 10.

Furthermore, it is apparent in FIG. 1 that the inner cross section area of the inner pipe changes in the axial direction of sound absorber 1. Starting from an inlet cross section area at an inlet 11 of sound absorber 1, the inner cross section area of inner pipe 10 narrows until it reaches an intermediate cross section area in a central area 15. From there the inner cross section area widens again up to an outlet cross section area at outlet 12 of sound absorber 1. The inlet cross section area and the outlet cross section area at inlet 11 and outlet 12 correspond approximately to the inner cross section area of pipe-shaped body 2. In this way, the flow may reach flow channel 4 of sound absorber 1 through pipe-shaped body 2 unhindered and with only low flow losses and may exit from there again into pipe-shaped body 2.

In the shown embodiment, inner pipe 10 has two conical sections 13, 14 which connect inlet 11 and outlet 12 with an area 15 having the narrowest cross section. In the shown embodiment, conical sections 13 and 14 have the same axial length. Area 15 having the narrowest cross section has a cylindrical cross section.

Each resonator chamber 5, 6, 7, 8 is delimited to the inside by inner pipe 10 and to the outside by a section of pipe-shaped body 2. In addition, sound absorber 1 has webs 16, 17, 18 so that multiple resonator chambers 5, 6, 7, 8 are separated in the space formed between inner pipe 10 and pipe-shaped body 2. Each of these webs 16, 17, 18 is situated on inner pipe 10 and has a ring-like circumferential design. The outer diameter of webs 16, 17, 18 corresponds to the inner diameter of pipe-shaped body 2 so that pipe-shaped body 2 is in tight contact with sound absorber 1 in the area of webs 16, 17, 18. The circumferential webs 16, 17, 18 point to the outside in the radial direction. Web 16 separates resonator chambers 5, 6 which are adjacent in the axial direction. Correspondingly, web 17 separates resonator chambers 6, 7 and web 18 separates resonator chambers 7, 8. Resonator chambers 5 and 8 are delimited at their outer ends by a section of inner pipe 10 which is in contact with pipe-shaped body 2. Resonator chambers 5, 6, 7, 8 have a constant outer diameter over their axial length, but a changing inner diameter.

Resonator chambers 5, 6, 7, 8 make noise reduction possible according to the Helmholtz resonator principle. For this purpose, resonator chambers 5, 6, 7, 8, each including a volume, are connected to flow channel 4 via connection channels 19 and 19', 20 and 20', 21 and 21' and 22 and 22'. In the shown embodiment, each resonator chamber 5, 6, 7, 8 is connected to flow channel 4 via two opposite connection channels 19 and 19', 20 and 20', 21 and 21' and 22 and 22'. Each connection channel encloses a small circular opening. Connection channels 19, 19', 20, 20', 21, 21', 22 and 22' have different lengths for each resonator channel 5, 6, 7, 8 which makes tuning to the intended frequency range possible. In the shown embodiment, the two opposite connection channels 19, 19' have a length equal to the wall thickness of inner pipe 10. The two connection channels 21, 21' are slightly longer. Connection channels 22, 22' and 20, 20' have a distinctly greater length. Connection channels 19, 19', 20, 20', 21, 21', 22, 22' are formed by a channel-like section of partition 9 and inner pipe 10. Connection channels 19, 19', 20, 20', 21, 21', 22, 22' may be placed at an intended position on the circumference of the insert.

The shown sound absorber 1 may be made of plastic as an injection molded part. Particularly suitable is an elastic plastic material. Sound absorber 1 is then also insertable with no problem into curved pipe-shaped bodies. Moreover, the sound absorber is then able to adapt itself with no problem to a flattening or ovalization of the pipe-shaped body, which may occur in the area of a curve of the pipe-shaped body, for example.

Figure 2:
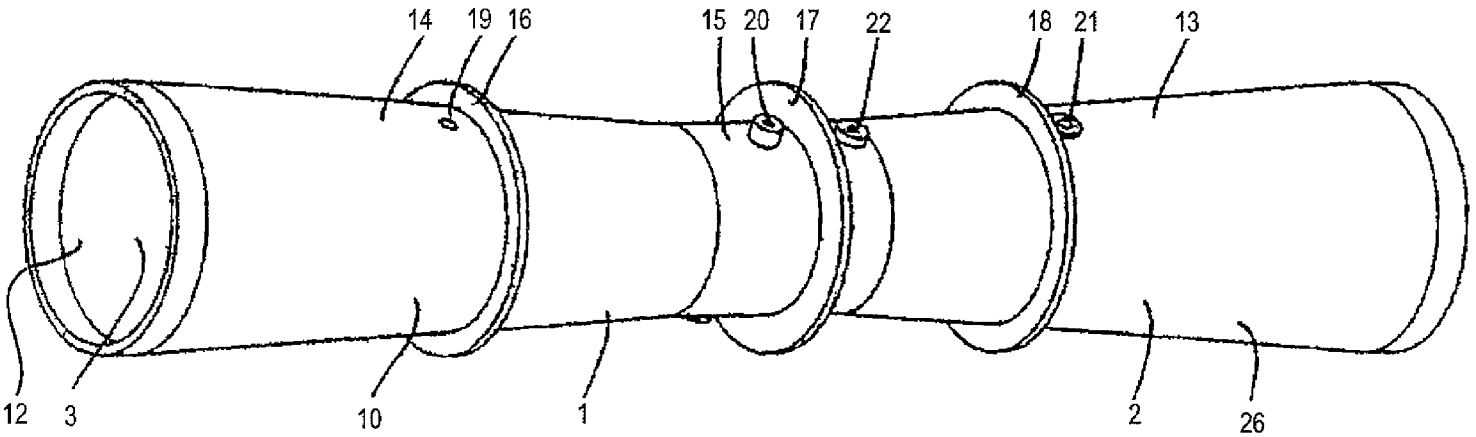
FIG. 2 shows a perspective view of a sound absorber illustrated in FIG. 1.

FIGS. 2*a* and 2*b* show sound absorber 1 from FIG. 1 prior to its insertion into the pipe-shaped body. Webs 16, 17, 18 situated on inner pipe 10 and the conical sections 13, 14 and area 15 having the narrowest cross section of inner pipe 10 are clearly recognizable. Furthermore, connection channels 19, 19', 20, 20', 21, 21', 22, 22' are clearly recognizable.

Figure 3:
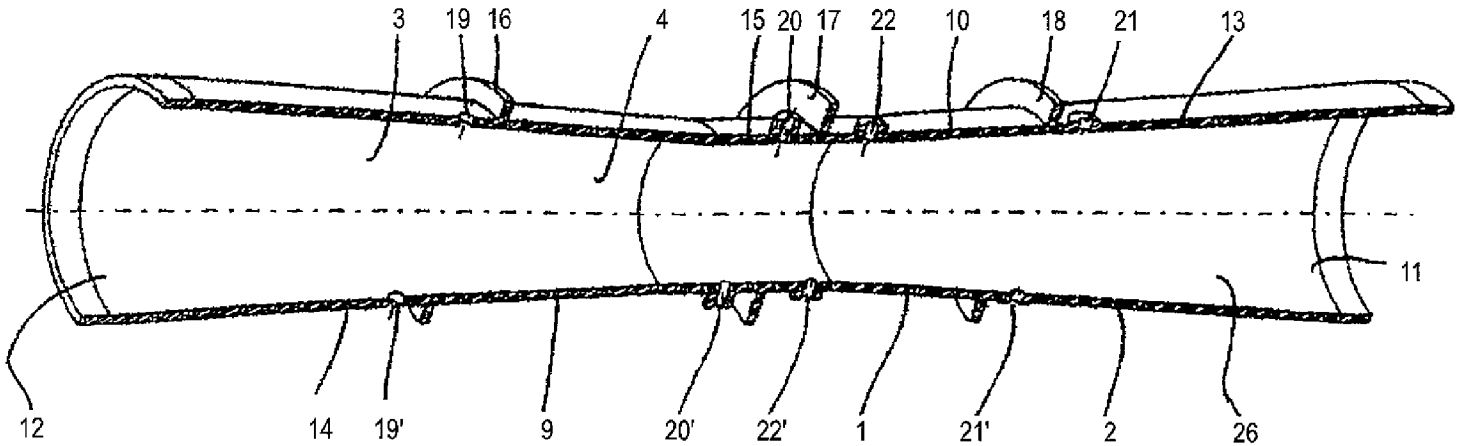
FIG. 3 shows a perspective sectional view of the sound absorber from FIG. 2.

FIGS. 3*a* and 3*b* show sound absorber 1 inserted into a pipe-shaped body 2 having a curve. For example, the pipe-shaped body may be designed as a hose which is installed with a curve. Since sound absorber 1 is made of an elastic plastic material, it is able to adapt to the curve of pipe-shaped body 2, even if it is manufactured in the straight shape shown in FIG. 2*a*. Also in a curved pipe-shaped body, webs 16, 17, 18 provide good contact of sound absorber 1 with the inside of the pipe-shaped body without preventing the pipe-shaped body from bending.

Figure 4:
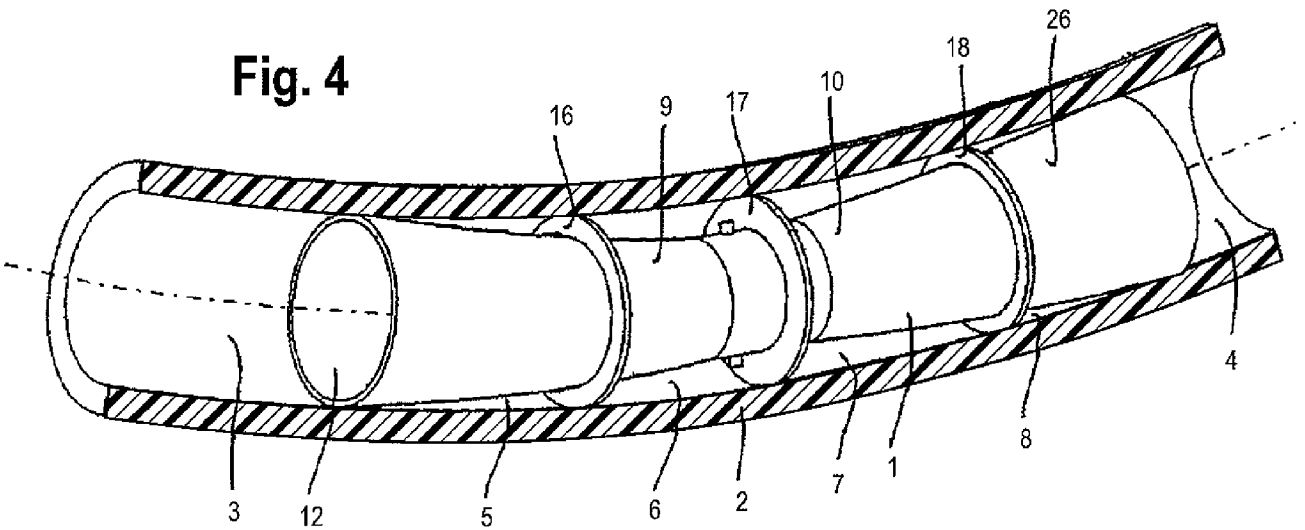
FIG. 4 shows the sound absorber from FIG. 1 inserted into a curved pipe-shaped body, the pipe-shaped body being shown in sectional view.
Figure 5:
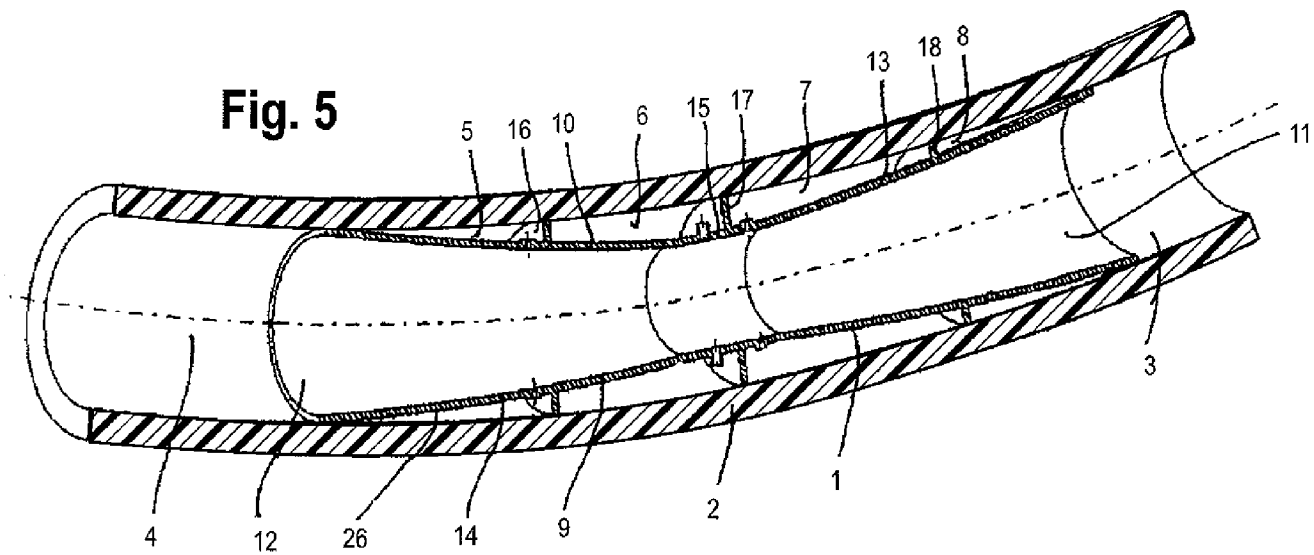
FIG. 5 shows a perspective sectional view of the sound absorber and the pipe-shaped body of FIG. 4.
Figure 6:
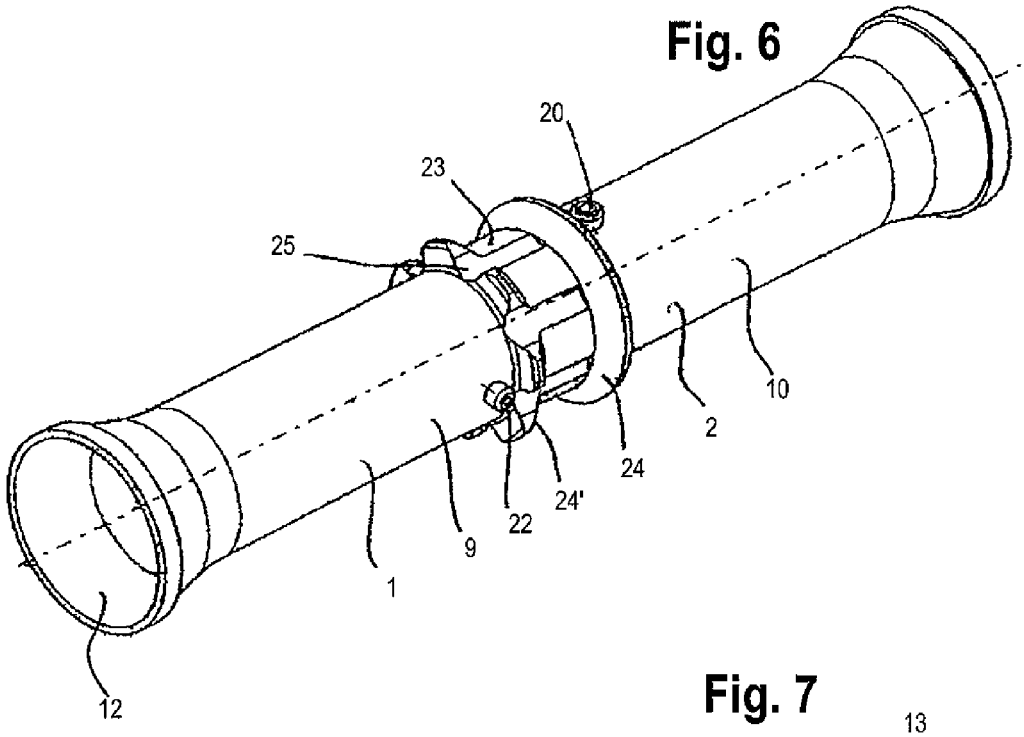
FIG. 6 shows a perspective view of another embodiment of a sound absorber according to the present invention.
Figure 7:
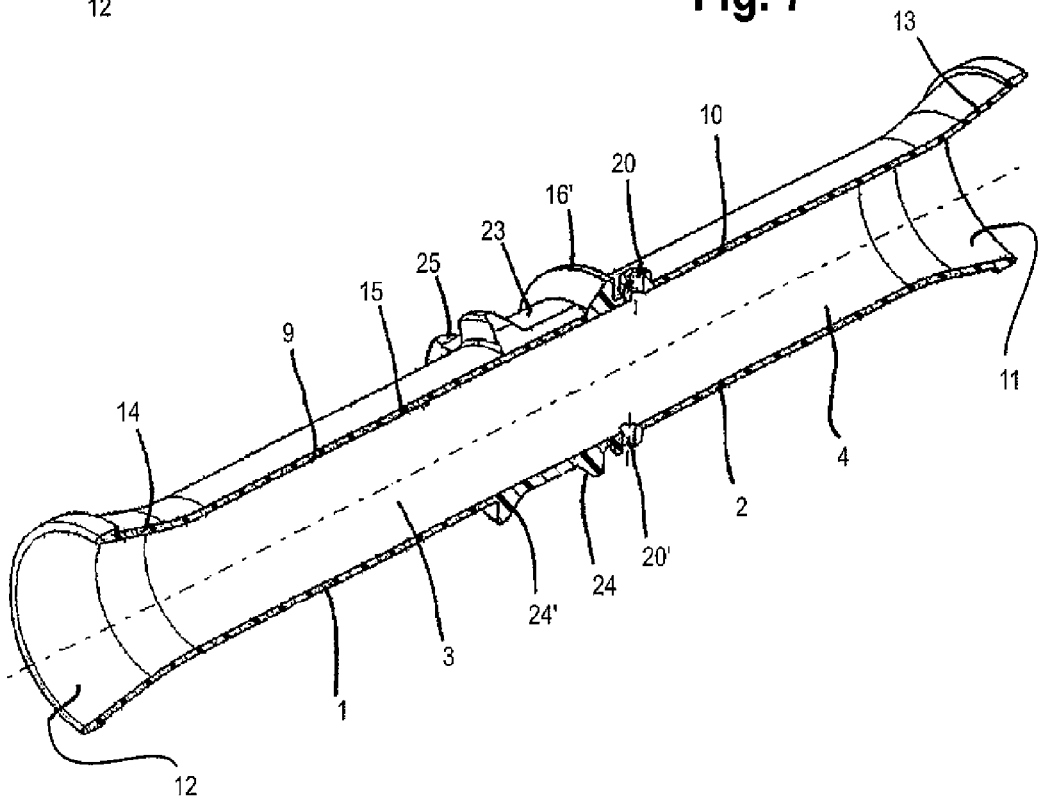
FIG. 7 shows a perspective sectional view of the sound absorber of FIG. 6.

FIGS. 4*a* and 4*b* show another embodiment of the sound absorber according to the present invention prior to its insertion into a pipe-shaped body. Parts having the same function are labeled with the same reference numerals as in the preceding figures. Reference is made to the respective description which also applies to FIGS. 4*a* and 4*b*.

In the embodiment shown in FIGS. 4*a* and 4*b*, only two resonator chambers are formed which are separated by the circumferential web 16 which has, like webs 16, 17, and 18 in the previously described embodiment, has a circumferential ring-like design. In addition, web 16' is situated protruding on the outside of inner pipe 10. Each of the resonator chambers is connected to flow channel 4 via two connection channels 20, 20' and 22, 22'. In the embodiment shown in FIGS. 4*a* and 4*b*, the inner pipe also has conical sections 13, 14. However, these sections are shorter in the axial direction than is the case in the embodiment shown in FIG. 1. Accordingly, the area 15 having the narrowest cross section is correspondingly longer. In this way, a greater volume is available for the resonator chambers.

For fixing sound absorber 1, the insert has a clamping zone 23 on the outside of inner pipe 10. If the pipe-shaped body is made of a deformable material, as is the case with a hose, the pipe-shaped body having sound absorber 1 may be fastened in clamping zone 23 using a clamping device, e.g., a hose clamp. In the shown embodiment, the wall thickness of inner pipe 10 is reinforced in clamping zone 23 for this purpose. Clamping zone 23 is delimited on both sides by clamping edges 24, 24' which point to the outside. Good axial fixing is achieved in this way. In the shown embodiment, clamping edge 24 is formed by an oblique side surface of web 16'. Clamping edge 24' spaced in the axial direction from clamping edge 24 has breakthroughs 25. In this way, the space on both sides of clamping edge 24' may form a continuous resonator chamber.

All references, including publications, patent applications, and patents, cited herein are hereby incorporated by reference to the same extent as if each reference were individually and specifically indicated to be incorporated by reference and were set forth in its entirety herein.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A coolant circuit for a cooling system including a circulating coolant, a pipe-shaped body with an inner wall defining a cavity in which said coolant circulates as a gas, a sound absorber having a flow channel and at least one resonator chamber and at least one connection channel connecting said flow channel and said at least one resonator chamber wherein said sound absorber comprises an insert, in the cavity of said pipe-shaped body, said insert forming said flow channel, delineating said at least one resonator chamber from said flow channel and including said at least one connection channel.

2. A coolant circuit for a cooling system as claimed in claim 1, wherein said insert includes a partition and the inner cross section area of said partition of said insert changes in the axial direction.

3. A coolant circuit for a cooling system as claimed in claim 2, wherein said partition has an inlet and an outlet and the cross section area of said partition starting at said inlet narrows to an intermediate cross section area and widens from said intermediate cross-sectional area to an outlet cross section area at said outlet.

4. A coolant circuit for a cooling system as claimed in claim 3, wherein said insert has at least one outward extending web contacting the interior wall of the pipe-shaped body, said at least one web delimiting said at least one resonator chamber axially of said insert.

5. A coolant circuit for a cooling system as claimed in claim 4, wherein said insert includes multiple webs extending from said partition delimiting multiple adjacent resonator chambers formed in the axial direction, each connected to the flow channel via at least one connection channel.

6. A coolant circuit for a cooling system as claimed in claim 5, wherein said connector channels are each formed by a channel-like section enclosing a small circular opening.

7. A coolant circuit for a cooling system as claimed in claim 6 wherein said connection channels are of different lengths for each resonator chamber.

8. A coolant circuit for a cooling system as claimed in claim 4, characterized in that said insert has a clamping zone for fixing in said pipe-shaped body.

9. A coolant circuit for a cooling system as claimed in claim 8 wherein said at least one web includes said clamping zone.

10. A coolant circuit for a cooling system as claimed in claim 5, wherein said resonator chambers have a changing inner diameter in an axial direction of said insert, while the outer diameter of said resonator chambers remain constant.

11. A coolant circuit for a cooling system as claimed in claim 10, wherein the sound absorber is made of an elastically bendable material.

12. A coolant circuit for a cooling system as claimed in claim 11, characterized in that the pipe-shaped body is a flexible hose having a generally uniform inner cross section area.

* * * * *